US008083818B2

(12) United States Patent
Ploeg et al.

(10) Patent No.: US 8,083,818 B2
(45) Date of Patent: Dec. 27, 2011

(54) METHOD AND SYSTEM FOR PRODUCING SYNTHESIS GAS

(75) Inventors: Johannes Everdinus Gerrit Ploeg, Bussum (NL); Jacobus Hendrikus Scheerman, Amsterdam (NL)

(73) Assignee: Shell Oil Company, Houston, TX (US)

( * ) Notice: Subject to any disclaimer, the term of this patent is extended or adjusted under 35 U.S.C. 154(b) by 844 days.

(21) Appl. No.: 11/609,732

(22) Filed: Dec. 12, 2006

(65) Prior Publication Data

US 2007/0151155 A1 Jul. 5, 2007

(30) Foreign Application Priority Data

Dec. 14, 2005 (EP) ..... 05112111

(51) Int. Cl.
*C10J 3/00* (2006.01)

(52) U.S. Cl. ..... 48/197 R

(58) Field of Classification Search ..... 48/210
See application file for complete search history.

(56) References Cited

U.S. PATENT DOCUMENTS

| | | | | |
|---|---|---|---|---|
| 2,941,877 | A | 6/1960 | Grahame | 48/196 |
| 5,534,659 | A | 7/1996 | Springer et al. | 588/227 |
| 6,269,286 | B1 | 7/2001 | Tse et al. | 700/271 |
| 2003/0089038 | A1 * | 5/2003 | Weaver | 48/210 |
| 2006/0204910 | A1 * | 9/2006 | Teng | 431/76 |

FOREIGN PATENT DOCUMENTS

| | | |
|---|---|---|
| DE | 282142 | 9/1990 |
| GB | 837074 | 6/1960 |
| WO | WO2006081661 | 10/2006 |

* cited by examiner

*Primary Examiner* — Alexa Neckel
*Assistant Examiner* — Imran Akram

(57) ABSTRACT

Method and system for producing synthesis gas by partial oxidation of a carbonaceous stream, wherein the partial oxidation is controlled using an oxygen to carbon ratio (O/C ratio). A carbonaceous stream and an oxygen containing stream is fed into a gasification reactor at a selected O/C ratio, where it is at least partially oxidized. A gaseous product stream is thereby obtained, which at least contains synthesis gas, $CO_2$ and possibly $CH_4$. The content of $CO_2$ in the product stream is determined, and compared with a pre-determined content thereby possibly obtaining a difference value between the determined content and the pre-determined content. The O/C ratio in step is adjusted based on the difference value.

10 Claims, 1 Drawing Sheet

METHOD AND SYSTEM FOR PRODUCING SYNTHESIS GAS

FIELD OF THE INVENTION

The present invention relates to a method of producing synthesis gas by partial oxidation of a carbonaceous stream.

BACKGROUND OF THE INVENTION

Methods for producing synthesis gas by partial oxidation are well known in practice.

Generally, a (hydro)carbonaceous stream such as coal, brown coal, peat, wood, coke, soot, or other gaseous, liquid or solid fuel or mixture thereof, is partially combusted in a gasification reactor (or otherwise partially oxidised) using an oxygen containing gas such as substantially pure oxygen or (optionally oxygen-enriched) air or the like, thereby obtaining a product stream containing a.o. synthesis gas (i.e. CO and $H_2$) and $CO_2$.

The product stream is usually further processed, e.g. to cool the product stream in a quench section and to remove undesired components. Also, the product stream may be subjected to shift conversion, wet gas scrubbing and the like, depending on the end use of the product stream or parts thereof.

In the known method of producing synthesis gas, the quality of the product stream obtained may vary, due to e.g. disturbances or variations in the carbonaceous stream and the oxygen containing stream being fed to the gasification reactor, the amount of ash in the carbonaceous stream, etc. If for example coal is used as the carbonaceous stream, variations in $H_2O$ content of the coal may result in altered process conditions in the gasification reactor, as a result of which the composition of the product stream will also vary. Various methods of controlling a partial oxidation process are known. For example GB-A-837074 describes a process wherein the carbon dioxide in the product gas of a partial oxidation process is measured to control the steam flow.

U.S. Pat. No. 2,941,877 describes a process for controlling the oxygen-to-carbon feed ratio in a partial oxidation reactor. The oxygen-to-carbon feed ratio is controlled by measuring the methane concentration in the product gas using infrared measurement technique. A disadvantage of using methane as the control input is that the signal is not a sharp signal, making control less accurate.

The quality variation mentioned above may be even more pertinent if the end user of (parts of) the product stream desires a constant quality with only very limited variations therein.

SUMMARY OF THE INVENTION

In one aspect, the present invention provides a method of producing synthesis gas by partial oxidation of a carbonaceous stream, wherein the partial oxidation is controlled using an oxygen to carbon ratio (O/C ratio), the method comprising at least the steps of:

(a) feeding a carbonaceous stream and an oxygen containing stream into a gasification reactor at a selected O/C ratio;

(b) at least partially oxidising the carbonaceous stream in the gasification reactor, thereby obtaining a gaseous product stream at least containing synthesis gas, $CO_2$ and $CH_4$;

(c) determining the content of $CO_2$ in the product stream obtained in step (b);

(d) comparing the content determined in step (c) with a pre-determined content thereby possibly obtaining a difference value between the content determined in step (c) and the pre-determined content;

(e) adjusting the O/C ratio in step (a) based on the difference value obtained in step (d).

In another aspect the present invention provides a system for producing synthesis gas by partial oxidation of a carbonaceous stream, the system at least comprising:

- a gasification reactor having an inlet for an oxygen containing stream, an inlet for a carbonaceous stream, and downstream of the gasification reactor an outlet for a product stream produced in the gasification reactor;
- a first flow controller for controlling the flow of the oxygen containing stream into the gasification reactor;
- a second flow controller for controlling the flow of the carbonaceous stream into the gasification reactor;
- a quality controller for determining the composition of the product stream and comparing thereof with a pre-determined composition, thereby possibly obtaining a difference value;

wherein the quality controller is functionally coupled with the first and second flow controllers and wherein the quality controller can adjust the flow rates in the first and second flow controllers, based on the difference value.

Such a system may be suitable for suitable for performing the method according to the first aspect of the invention, preferably according to one or more embodiments of the invention.

The invention will now be described by way of example in more detail with reference to the accompanying non-limiting drawing.

BRIEF DESCRIPTION OF THE DRAWING

In the accompanying drawing.

DETAILED DESCRIPTION

Figure 1:
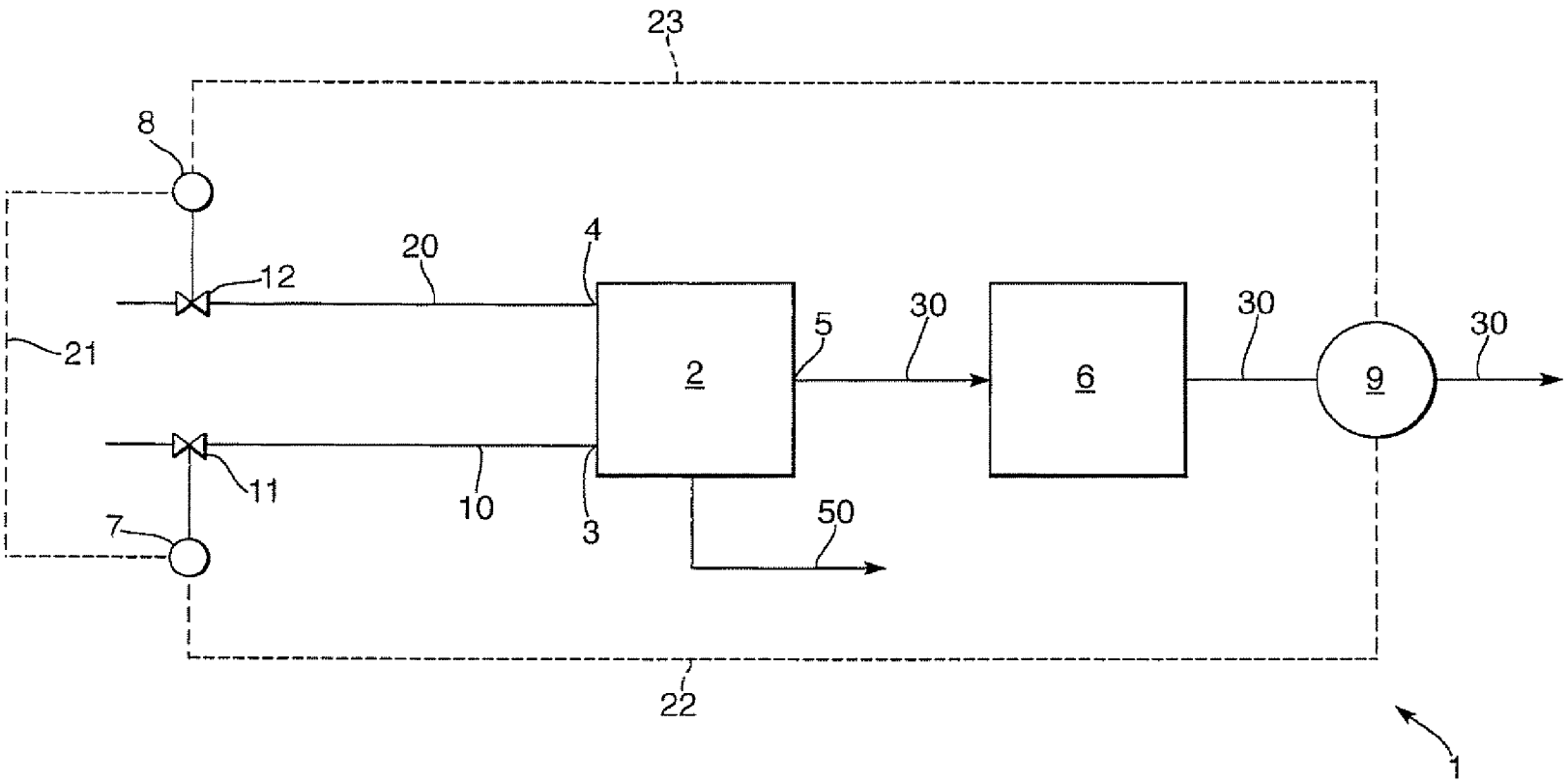
FIG. 1 schematically shows a system for performing the method according the present invention.

For the purpose of this description, a single reference number will be assigned to a line as well as a stream carried in that line. Same reference numbers refer to similar structural elements.

It has been surprisingly found that by controlling the oxygen to carbon ratio (O/C ratio) on basis of the content of $CO_2$ in a synthesis gas product stream, process conditions in a gasification reactor (such as the gasification temperature), and thereby the quality of the product stream, may be controlled in a very simple manner.

Applicants further found that the content of $CO_2$ in the product stream gives a sharp signal as compared to the signal of $CH_4$ as measured by infrared, making it more suited to control this process. Applicants further found that controlling the C/O ratio is much more efficient than controlling the steam flow in order to achieve a product stream having a constant quality with only very limited variations therein.

The carbonaceous stream may be any suitable liquid, gaseous or solid stream (including slurries) suitable to be partially oxidised thereby obtaining a synthesis gas containing product stream. The term 'carbonaceous' is meant to also include 'hydrocarbonaceous'. It has been found that methods provided by the present invention may be especially suitable if as a carbonaceous stream preferably a solid, particulate, high carbon containing feedstock is used. A preferred feed is a solid carbonaceous feed. Examples of such feeds are coal, biomass, for example wood and waste, preferably coal. More preferably the solid carbonaceous feed is substantially, i.e. >90 wt. %, comprised of naturally occurring coal or synthetic (petroleum)cokes. Suitable coals include lignite, bituminous coal, sub-bituminous coal, anthracite coal, and brown coal. The solid carbonaceous feed may be fed to the process as a slurry in water, or, more preferably, as a mixture of the feed and a suitable carrier gas. A suitable carrier gas is nitrogen.

As oxygen containing stream any suitable stream may be used. Usually substantially pure oxygen (e.g. obtained using an Air Separation Unit) will be used. However, also air or oxygen-enriched air may be used.

The person skilled in the art will readily understand how to select the desired selected O/C ratio for a specific carbonaceous stream to be fed in step (a). In the present specification and claims, the O/C ratio has the following meaning, wherein 'O' is the weight flow of molecular oxygen, $O_2$, as present in the oxygen containing stream and wherein 'C' is the weight flow of the carbonaceous feed excluding any optional carrier gas or water, in case of a slurry. The desired selected O/C ratio may e.g. be determined using known energy content data for a specific carbonaceous stream such as the heating value of the feedstock in J/kg. Usually, having determined the desired selected O/C ratio, the $O_2$ content in the oxygen containing stream will be determined and the suitable flow rates for the carbonaceous and oxygen containing feed streams will be established to obtain the desired O/C ratio.

The content of $CO_2$ may be determined by means of infrared, although other measurement techniques can also be used. The content of $CO_2$ is preferably measured in the gas stream as close to the partial oxidation step as possible for obvious control reasons. Nevertheless applicants found that the process can still be effectively controlled when the $CO_2$ content is measured downstream of a water gas scrubber. This can be advantageous because the scrubbed gas will contain fewer acids making the analysis simpler. Also the person skilled in the art will understand how the determining of the content in step (c) can be done; therefore this will not be further discussed here.

The comparing of the content of the product stream with the pre-determined content may be done by hand. However, normally e.g. a suitable computer program will be used. The pre-determined content usually corresponds to the content of the expected product composition (or an expected content of one or more components thereof) that would have been obtained on basis of the selected O/C ratio if no variations or disturbances would occur. If a difference exists (i.e. the difference value) between the actual content of the product stream and the pre-determined content, then the O/C ratio is adjusted to some extent e.g. by adjusting the flow rates of the feed streams. As a result of the adjusting of the O/C ratio, the process conditions will be changed (and the steps (c) to (e) repeated) until the actual content obtains a desired value.

The person skilled in the art will understand that, if desired, the O/C ratio will only be adjusted if the difference value is above a pre-selected value. Further, the adjustment of the O/C ratio will depend on to what extent the product stream composition deviates from the pre-determined composition.

It has been contemplated that the $CO_2$ content in the product stream content are especially suitable for comparison purposes. Thus, preferably the difference value obtained in step (c) is obtained on the basis of a comparison between the content of $CO_2$ in the product stream and the pre-determined content for $CO_2$.

If a difference value occurs (optionally above a preset value), the O/C ratio may be adjusted in step (e) by adjusting the flow rate of one of the carbonaceous stream and the oxygen containing stream fed in step (a) or a combination thereof. Preferably the carbonaceous stream is adjusted in step (e), while keeping the oxygen stream constant.

Reference is made to FIG. 1. FIG. 1 schematically shows a system 1 for producing synthesis gas. A carbonaceous stream 20, such as a coal containing stream, and an oxygen containing stream 10, such as air, may be fed into a gasification reactor 2 at inlets 4, 3, respectively, and at a selected O/C ratio. In the shown embodiment of FIG. 1, the selected O/C ratio is obtained by the first and second flow controllers 7, 8. The first and second flow controllers 7, 8 are operatively connected (as indicated by dashed line 21). Furthermore, each of the first and second flow controllers 7, 8 comprise a valve, schematically denoted with reference numbers 11 and 12.

The carbonaceous stream 20 is at least partially oxidised in the gasification reactor 2, thereby obtaining a gaseous product stream 30, typically comprising synthesis gas (i.e. $CO+H_2$), $CO_2$ and $CH_4$. To this end usually several burners (not shown) are present in the gasification reactor 2. As coal is used as the carbonaceous stream 20, also a slag is formed which is removed via line 50 for further processing.

Usually, the partial oxidation in the gasification reactor 2 may be carried out at a temperature in the range from about 1200 to about 1800° C. and at a pressure in the range from about 1 to about 200 bar, typically at about 40 bar.

As shown in the embodiment of FIG. 1, the produced product stream 30 containing the synthesis gas is fed to a quenching section 6; herein the stream 30 is usually cooled to about 350° C. The quenching section 6 may have any suitable shape, but will usually have a tubular form.

The person skilled in the art will readily understand that the product stream 30 leaving the quenching section 6 may be further processed. To this end, it may be fed into e.g. a dry solids removal unit (not shown), a wet gas scrubber (not shown), to a shift converter (not shown), etc.

The product stream 30 containing the synthesis gas leaving the quenching section 6, and optionally leaving a further downstream wet gas scrubber, is fed to a quality controller 9, in which the content of $CO_2$ of the product stream 30 is determined and compared with a pre-determined content of $CO_2$. This pre-determined content of $CO_2$ may e.g. correspond to the expected content of $CO_2$ of product stream 30 that would have been obtained on the basis of the selected O/C ratio if no variations or disturbances would occur.

If the composition of the product stream 30 deviates from the pre-determined content of $CO_2$, the O/C ratio of the streams 10 and 20 is adjusted thereby also affecting the process conditions in the gasification reactor 2. The person skilled in the art will understand that, if desired, the O/C ratio may only be adjusted if the deviation (i.e. the difference value) is above a pre-set value.

In order to achieve the desired adjustment of the O/C ratio of the stream 10 and 20, the quality controller 9 operates the flow controllers 7 and 8 (as indicated by the dashed lines 22 and 23) and as a result the flow rates of the streams 10 and/or 20 are adjusted accordingly. As a consequence, the process conditions (in particular the gasification temperature) in the gasification reactor 2 are altered thereby also altering the content of $CO_2$ of the product stream 30. These adjustments of the O/C ratio may take place as long as the content of $CO_2$ of the product stream 30 deviates from the pre-determined content of $CO_2$.

Hereafter a non-limiting example of the method according to the invention is discussed.

EXAMPLE

Using the line-up as generally shown in FIG. 1, synthesis gas was produced by partial oxidation of a solid, particulate coal stream, which was initially fed into the gasification reactor. As oxygen containing stream substantially pure oxygen (obtained from an ASU) was used.

The coal and oxygen streams were fed in order to (tentatively) obtain a selected O/C ratio of about 0.713. After partially oxidising the coal stream in the gasification reactor at a temperature of about 1500° C. and a pressure of about 40 bar, a gaseous product stream was obtained. The composition of the gaseous product stream was determined and is given in Table I below (indicated as 'actual composition').

In the Example the content of $CO_2$ in the product stream was measured by infrared measurement technique and compared with a (calculated) pre-determined content of $CO_2$ in the product stream (also indicated in Table I) as a result of which a difference value between the content of $CO_2$ in the actual composition and the pre-determined composition (in the present Example: 0.74 mol %) was obtained. The difference value was expressed as a percentage of the absolute difference between the content of $CO_2$ in the product stream and the pre-determined $CO_2$ content relative to the pre-determined $CO_2$ content.

As the difference value of $CO_2$ was deemed too high (exceeding a pre-selected value of between 0.5% and 5%, in the present Example the pre-selected value was 1%, of the predetermined content), the O/C ratio of the coal and oxygen streams fed into the gasification reactor was adjusted by amending the flow rate of the coal stream while keeping the flow rate of the oxygen stream constant. This was repeated as long as the difference value between the actual content of $CO_2$ and the predetermined content of $CO_2$ in the product stream was less than the pre-selected value of 1%.

It goes without saying that a pre-selected value different from 1% (such as e.g. 0.5%) may be chosen, if desired. Suitably, the pre-selected value lies between 0.5% and 5%.

TABLE I

Composition of gaseous product stream.

| Component | Actual composition | Predetermined composition (calculated) | Difference value |
|---|---|---|---|
| $H_2O$ [mol %] | 19.85 | 19.85 | |
| $H_2$ [mol %] | 19.22 | 19.55 | |
| CO [mol %] | 46.39 | 46.91 | |
| $H_2S$ [mol %] | 0.38 | 0.38 | |
| $N_2$ [mol %] | 7.83 | 7.71 | |
| Ar [mol %] | 0.07 | 0.06 | |
| $NH_3$ [mol %] | 0.01 | 0.01 | |
| COS [mol %] | 0.05 | 0.05 | |
| HCN [mol %] | 0.01 | 0.01 | |
| $CO_2$ [mol %] | 6.19 | 5.45 | 0.74 (*) |
| $CH_4$ [mol %] | 0.0024 | 0.0047 | 0.0023 |

(*) This result is a difference value of ~13%, exceeding the pre-selected value of 1%.

The person skilled in the art will readily understand that the present invention may be modified in various ways without departing from the scope as defined in the claims.

We claim:

1. A method of producing synthesis gas by partial oxidation of a carbonaceous stream, wherein the partial oxidation is controlled using an oxygen to carbon ratio, the method comprising at least the steps of:

(a) feeding a carbonaceous stream and an oxygen containing stream into a gasification reactor at a selected oxygen to carbon ratio;

(b) at least partially oxidising the carbonaceous stream in the gasification reactor, thereby obtaining a gaseous product stream at least containing synthesis gas and a content of $CO_2$;

(c) determining the content of $CO_2$ in the product stream obtained in step (b);

(d) comparing the content determined in step (c) with a pre-determined content thereby possibly obtaining a difference value between the content of $CO_2$ determined in step (c) and the pre-determined content of $CO_2$ wherein the difference value is expressed as a percentage of the absolute difference between the content of $CO_2$ in the product stream and the pre-determined $CO_2$ content relative to the pre-determined $CO_2$ content;

(e) adjusting the oxygen to carbon ratio in step (a) when the difference value obtained in step (d) exceeds a pre-selected value and wherein the pre-selected value is between 0.5% and 5%.

2. The method according to claim 1, where the carbonaceous stream fed in step (a) comprises particulate coal.

3. The method according to claim 1, wherein the oxygen to carbon ratio is adjusted in step (e) by adjusting the flow rate of one of the carbonaceous stream and the oxygen containing stream fed in step (a) or a combination thereof.

4. The method according to claim 3, wherein the oxygen to carbon ratio is adjusted by adjusting the flow rate of the carbonaceous stream, while keeping the oxygen containing stream constant.

5. The method according to claim 1, wherein the gaseous product stream further contains $CH_4$.

6. A method of producing synthesis gas by partial oxidation of a carbonaceous stream, wherein the partial oxidation is controlled using an oxygen to carbon ratio, the method comprising at least the steps of:

(a) feeding a carbonaceous stream and an oxygen containing stream into a gasification reactor at a selected oxygen to carbon ratio;

(b) at least partially oxidising the carbonaceous stream in the gasification reactor, thereby obtaining a gaseous product stream at least containing synthesis gas, $CH_4$, and a content of $CO_2$;

(c) determining the content of $CO_2$ in the product stream obtained in step (b);

(d) comparing the content determined in step (c) with a pre-determined content thereby possibly obtaining a difference value between the content of $CO_2$ determined in step (c) and the pre-determined content of $CO_2$ wherein the difference value is expressed as a percentage of the absolute difference between the content of $CO_2$ in the product stream and the pre-determined $CO_2$ content relative to the pre-determined $CO_2$ content;

(e) adjusting the oxygen to carbon ratio in step (a) when the difference value obtained in step (d) exceeds a pre-selected value and wherein the pre-selected value is between 0.5% and 5%.

7. The method according to claim 6, wherein the difference value is expressed as a percentage of the absolute difference between the content of $CO_2$ in the product stream and the pre-determined $CO_2$ content relative to the pre-determined $CO_2$ content and wherein step (e) is performed when the difference value exceeds a pre-selected value and wherein the pre-selected value is between 0.5% and 5%.

8. The method according to claim 6, where the carbonaceous stream fed in step (a) comprises particulate coal.

9. The method according to claim 1, wherein the oxygen to carbon ratio is adjusted in step (e) by adjusting the flow rate of one of the carbonaceous stream and the oxygen containing stream fed in step (a) or a combination thereof.

10. The method according to claim 9, wherein the oxygen to carbon ratio is adjusted by adjusting the flow rate of the carbonaceous stream, while keeping the oxygen containing stream constant.

* * * * *